United States Patent [19]

Richardson et al.

[11] Patent Number: 4,864,827

[45] Date of Patent: Sep. 12, 1989

[54] COMBUSTOR

[75] Inventors: John Richardson; Anthony Pidcock, both of Derby, United Kingdom

[73] Assignee: Rolls-Royce PLC, London, England

[21] Appl. No.: 183,098

[22] Filed: Apr. 19, 1988

[30] Foreign Application Priority Data

May 6, 1987 [GB] United Kingdom ..... 8710647

[51] Int. Cl.[4] ..... F23R 3/06

[52] U.S. Cl. ..... 60/756; 60/755

[58] Field of Search ..... 60/756, 754, 748, 752, 60/755

[56] References Cited

U.S. PATENT DOCUMENTS

| | | | |
|---|---|---|---|
| 4,180,974 | 1/1980 | Stenger et al. | 60/756 |
| 4,184,326 | 1/1980 | Pane, Jr. et al. | 60/757 |
| 4,695,247 | 9/1987 | Enzaki et al. | 60/756 |

FOREIGN PATENT DOCUMENTS

| | | | |
|---|---|---|---|
| 994115 | 8/1976 | Canada | 60/756 |
| 268524 | 5/1950 | Switzerland | 60/756 |
| 1550368 | 8/1979 | United Kingdom . | |
| 2087065 | 5/1982 | United Kingdom . | |

*Primary Examiner*—Louis J. Casaregola
*Assistant Examiner*—Timothy S. Thorpe
*Attorney, Agent, or Firm*—Cushman, Darby & Cushman

[57] ABSTRACT

A gas turbine engine combustor is provided with a semi-spherical upstream wall constituted by two correspondingly shaped skins which are spaced apart by pedestals attached to one of the skins to define a space between them. Cooling air is progressively metered into to space through apertures in the first upstream skin to provide effective cooling of the second downstream skin. The cooling air is exhausted from the space through an outlet defined by the first skin and the periphery of the second skin to provide film coating of the upstream end of the combustor side wall.

7 Claims, 2 Drawing Sheets

COMBUSTOR

This invention relates to combustors and in particular to combustors suitable for gas turbine engines.

In one form of gas turbine engine, the combustion system of the engine comprises a number of similar combustors which are disposed in an annular array downstream of the compressor of the engine and upstream of its turbine. Each combustor has a generally semi-spherical dome-shaped upstream end (with respect to gas flow direction) which is commonly referred to as the "head" of the combustor. The combustor head usually has provision in its centre region for a fuel spray nozzle which is adapted to introduce an appropriate fuel into the combustor. It will be appreciated however that other fuel introduction means may be positioned in the combustor head central region if so desired. Thus for instance a so-called fuel vapouriser may be used.

The combustor head must be capable of withstanding the high temperature environment of the combustor over long periods of time without sustaining damage. This is conventionally achieved by passing cooling air through the combustor head when the combustor is in operation so that the material from which the head is manufactured is not permitted to reach a temperature at which it may melt or crack as a result of thermal stress. One convenient and well known way of achieving this end is to provide a number of so-called "flares" in the head. Each flare comprises a number of holes which interconnect the upstream and downstream faces of the head and a number of suitably shaped deflectors which direct the cooling air flowing through the holes over the downstream face of the head in the form of films. These films of cooling air are intended to protect the combustor head from the high temperature combustion process which takes place within the combustor. However, to achieve this end, relatively large amount of cooling air are necessary and this can have an adverse effect upon combustion efficiency. Other drawbacks with the use of flares include local reductions in cooling air flow as a result of flare distortion, combustion promotion by the cooling air thereby exacerbating the head cooling process and the difficulty usually encountered in protecting the head from radiant heat by the use of films of cooling air.

An alternative form of combustor head construction makes use of the concept of transpiration cooling. Thus the head is made up of two layers of sheet material which are bonded together and include cooling air passages which interconnect apertures in the upstream sheet with apertures in the downstream sheet. Apertures in the upstream and downstream sheets are not aligned so that cooling air flows for short distances with the head in directions which are generally transverse to the directions of cooling air entering and existing the head.

While transpiration cooling makes more economic use of cooling air and overcomes some of the drawbacks of head cooling using flares, heads which utilise transpiration cooling do have a tendency to crack. Such cracking results from the high thermal gradients which are encountered in combustor heads.

It is an object of the present invention to provide a combustor suitable for a gas turbine engine in which the drawbacks referred to above are substantially obviated.

According to the present invention, a combustor suitable for a gas turbine engine comprises a wall defining at least the majority of the upstream end of said combustor, said wall comprising first and second generally correspondingly shaped skins and spacer means associated with said skins to maintain said skins in spaced apart relationship whereby a space is defined therebetween, the first of said skins being operationally exposed to a source of pressurised cooling fluid and the second of said skins defining a portion of the interior surface of said combustor, said first skin having a plurality of apertures therein permitting the flow of said pressurised cooling fluid into said space defined between said skins, said second skin being substantially continuous and having a periphery which co-operates with said first skin to define an outlet for the egress of said cooling fluid from said space between said skins into the interior of said combustor.

The invention will now be described, by way of example, with reference to the accompanying drawings in which.

Figure 1:
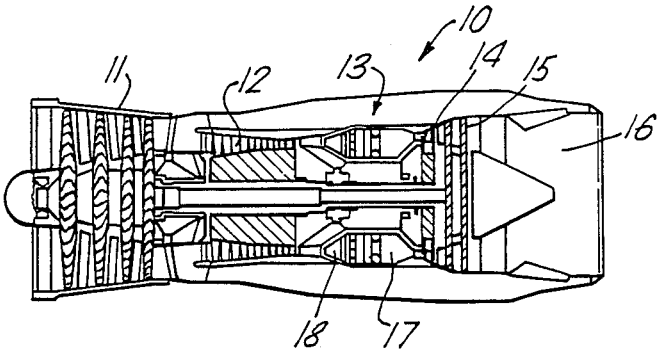
FIG. 1 is a sectional side view of a gas turbine engine incorporating a combustor in accordance with the present invention.

With reference to FIG. 1 a gas turbine by-pass engine generally indicated at 10 comprises, an axial flow series, a low pressure compressor 11, a high pressure compressor 12, combustion equipment 13, a high pressure turbine 14, a low pressure turbine 15 and an exhaust nozzle 16. The engine 10 functions in the conventional manner in that air compressed by the low and high pressure compressors 11 and 12 is mixed with fuel in the combustion equipment 13 and the mixture is combusted. The resultant exhaust gases expand through the high and low pressure turbines 14 and 15, which respectively drive the high and low pressure compressors 12 and 11, and are exhausted through the exhaust nozzle 16 to provide propulsive thrust. Part of the air compressed by the low pressure compressor 11 by-passes the high pressure compressor 12, combustion equipment 13, high pressure turbine 14 and low pressure turbine to mix with the exhaust gases in the exhaust nozzle 16.

The combustion equipment 13 comprises a plurality of combustors 17 which are equally spaced apart in an annular array. Each combustor 17 comprises an upstream end 18 in which is located a fuel injection nozzle (not shown) for the introduction of an appropriate fuel, which may be in liquid or gaseous form, into the interior of the combustor 17. The upstream end of one combustor 17 can be seen more clearly if reference is made to FIG. 2.

Figure 2:
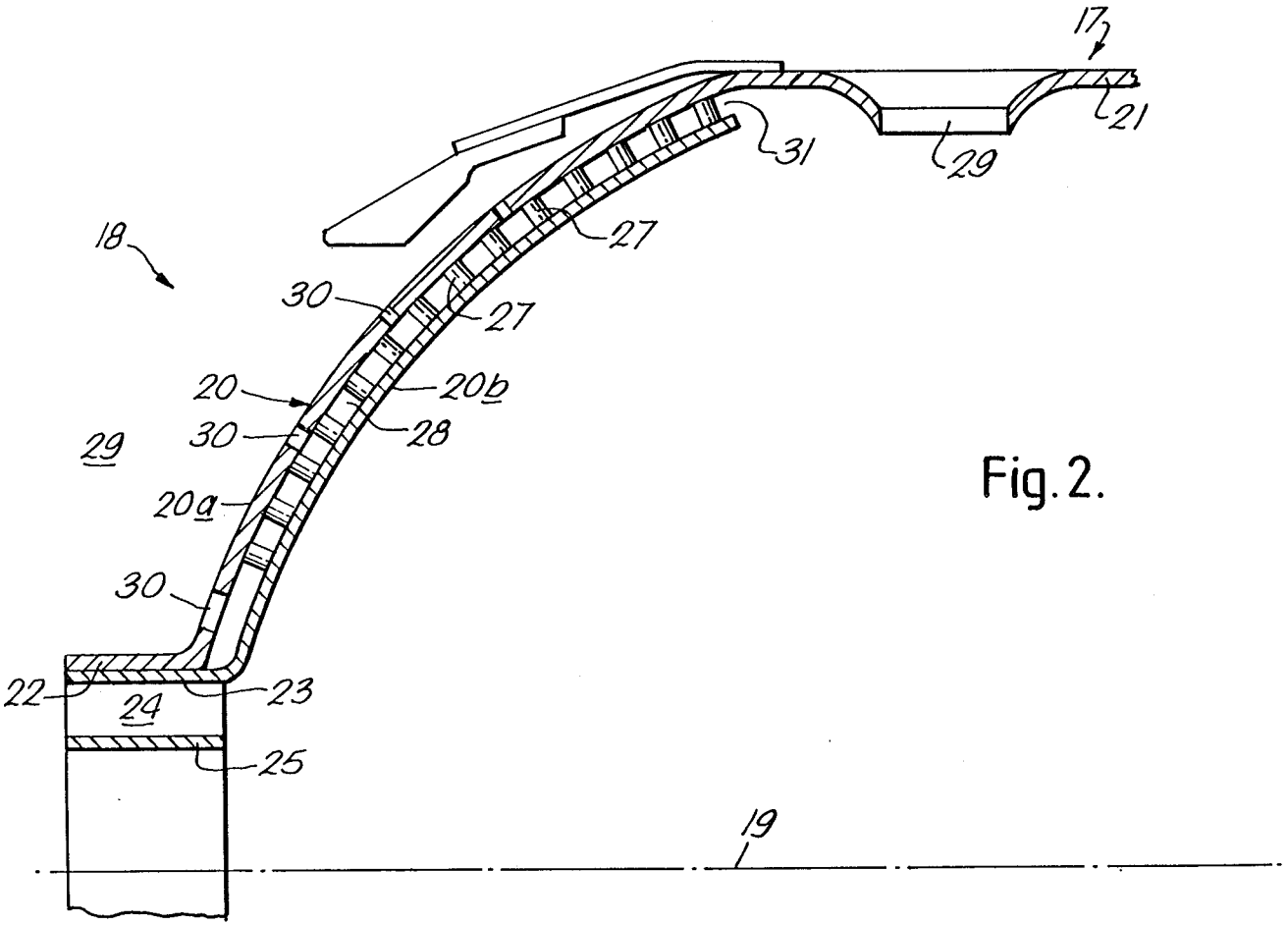
FIG. 2 is a sectional side view of a portion of the upstream end of a combustor in accordance with the present invention.

In FIG. 2 there can be seen the notional centre line 19 of the combustor 17, a portion of the combustor upstream end wall or head 20 and a portion of the combustor side wall or barrel 21.

The combustion head 20 comprises first and second generally semi-spherically shaped skins **20*a* and 20*b*. The first skin 20*a* is located upstream of the second skin 20*b* and has a aperture in its central region which is defined by a sleeve 22. Similarly the second skin 20*b* has an aperture in its central region which is defined by a second sleeve 23. However the second sleeve 23 is of smaller diameter than the sleeve first 22 to permit the location of the second sleeve 23 within the first sleeve 22**.

The second skin 20b is thus supported from the first skin 20a by the interaction of their respective sleeves 23,22.

The second sleeve 23 carries a plurality of swirler vanes 24, the radially inner extents of which in turn carry a third sleeve 25 which is adapted to provide support for a conventional fuel injection nozzle (not shown).

Figure 3:
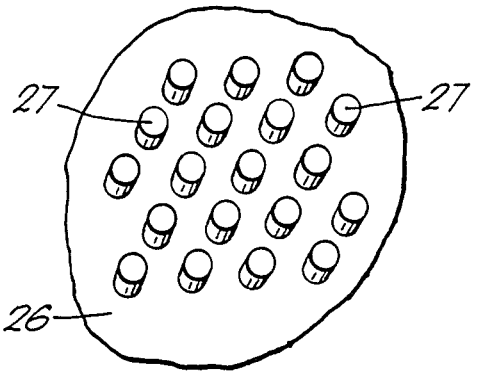
FIG. 3 is a pictorial view of a portion of the combustor shown in FIG. 2.

The first and second skins 20a and 20b are equally spaced apart by a plurality of cylindrical pedestals 27 which are attached to the second skin 20b although it will be appreciated that such equal spacing is not necessarily essential. However the pedestals 27, some of which can be seen more clearly in FIG. 3, are not attached to the first skin 20a but they merely abut it. Thus a space 28 is defined between the first and second skins 20a and 20b of the head 20.

The region 29 upstream of the combustor head 20 receives, in operation, a supply of pressurised air from the downstream end of the high pressure compressor 12. The majority of that pressurised air passes into the interior of the combustor 17 in the conventional manner through the swirler vanes 24 and various air inlets, such as that shown at 29, along the combustor barrel 21. However, some of that pressurised air passes into the space 28 between the first and second skins 20a and 20b through a number of apertures 30 which are provided in the first skin 20a. The second skin 20b is substantially continuous and has no such corresponding apertures 30. This cooling air serves to ensure that the second skin 20a, which is directly exposed to the combustion process operationally taking place within the combustor 17, is maintained at an acceptably low temperature.

The apertures 30 are graded in size and quantity to take account of varying heat fluxes from within the combustor 17. In this particular case, the apertures 30 which are closest to the combustor axis 19 are of the largest diameter whereas the diameters of the remaining apertures 30 decrease as they are further spaced from the axis 19. Since the first ring 23 engages the sleeve 22, the only route for cooling air into the space 28 is via the apertures 30. The result of this is that the variation in diameter and the positioning of the apertures 30 ensures that cooling air is progressively metered into the space 28. The actual degree of progressive metering is chosen such that the velocity of the cooling air within the space 28, and hence the rate at which it provides heat removal, is sufficient to maintain the temperature of the inner skin 20b at an acceptably low level.

The pedestals 27, as well as spacing apart the skins 20a and 20b, serve to assist in the conduction of heat from the inner skin 20b and are, of course, cooled by the cooling air flow within the space 28. This being so the cooling of the inner skin 20b is very effective and so it is not necessary to provide the face of the skin 20b confronting the interior of the combustor 17 with conventional film cooling, that is flows of cooling air over the surface exposed to the heat source.

Since the pedestals 27 are not attached to the first skin 20a but merely abut it, thermal gradients within the head 20 do not result in the cracking of the pedestals 27 or either of the first and second skins 20a and 20b through thermal stress. As thermal gradients occur within the head 20, the pedestals 27 merely move relative to the first skin 20a.

The radially outer extent of the first skin 20a is integral with the combustor barrel 21. However, the periphery of the second skin 20b is spaced apart from the barrel 21 so that an annular gap 31 is defined between them. The gap 31 constitutes an outlet for the cooling air flowing into and through the space 28 between the first and second skins 20a and 20b, into the interior of the combustor 17. Indeed the cooling air exhausted from the gap 31 provides a certain degree of film cooling of the upstream end of the barrel 21. Moreover the flow of cooling air through the gap 31 is unlikely to change with time since the pedestals 27 ensure that the gap 31 remains substantially constant throughout the life of the combustor 17.

It will be seen therefore that combustors 17 in accordance with the present invention are resistant to damage as a result of thermally induced stresses and are particularly efficient in their use of cooling air which in turn brings about a corresponding increase in the level of efficiency in the operation of the combustor 17.

Although the present invention has been described with reference to a gas turbine engine 10 provided with a number of separate combustors 17, it is also applicable to gas turbine engines provided with a single annular combustor. In such circumstances, the first and second skins 20a and 20b may not necessarily be of semi-spherical dome-shaped construction.

We claim:

1. A combustor suitable for a gas turbine engine comprising a wall defining at least the majority of the upstream end of said combustor, said wall comprising first and second generally correspondingly shaped skins which skins are each of generally semi-spherical configuration and a plurality of pedestals attached to one of said skins and abutting the other said skins to maintain said skins in spaced apart relationship whereby a space is defined therebetween, the first of said skins being operationally exposed to a source of pressurised cooling fluid, and the second of said skins defining a portion of the interior surface of said combustor, said pedestals assisting in the conduction of heat from the second skin, said first skin having a plurality of apertures therein for permitting the flow of said pressurised cooling fluid into said space defined between said skins, the apertures in the first outer skin progressively decreasing in size the further they are spaced apart from the combustor center line so as to provide a progressive metering of cooling fluid into said space defined between said first and second skins, said second skin being substantially continuous and having a periphery which co-operates with said first skin to define an outlet for the egress of said cooling fluid from said space between said skins into the interior of said combustor, each of said first and second skins being provided with an additional aperture at its central region and an axially extending sleeve around its corresponding aperture, the sleeve of said second skin locating within and being supported by the sleeve of said first skin.

2. A combustor as claimed in claim 1 wherein said pedestals are attached to said second skin.

3. A combustor as claimed in claim 1 wherein said combustor is provided with a side wall and said first skin is integral with said side wall.

4. A combustor as claimed in claim 1 wherein said sleeves extend in an upstream direction.

5. A combustor as claimed in claim 1 wherein said sleeve attached to the said second skin carries a plurality of swirler vanes.

6. A combustor as claimed in claim 1 wherein said outlet for the egress of cooling air is located adjacent the side wall of said combustor so as to provide film cooling thereof.

7. A combustor as claimed in claim 1 wherein said cooling fluid is air.

* * * * *